United States Patent [19]

Smith

[11] Patent Number: 4,575,150

[45] Date of Patent: Mar. 11, 1986

[54] SUSPENSION ARRANGEMENT FOR A TILTING CHAIR

[75] Inventor: David W. Smith, Calgary, Canada

[73] Assignee: SimoDow Manufacturing Ltd., Calgary, Canada

[21] Appl. No.: 599,789

[22] Filed: Apr. 13, 1984

[51] Int. Cl.[4] ..... A47C 3/00

[52] U.S. Cl. ..... 297/300; 248/624; 297/301

[58] Field of Search ..... 297/300, 301, 304, 305, 297/285, 208, 212; 248/624, 626, 627, 628, 909

[56] References Cited

U.S. PATENT DOCUMENTS

| | | | |
|---|---|---|---|
| 526,265 | 9/1894 | Rossetti | 297/208 X |
| 1,523,746 | 1/1925 | Boliston | 297/301 |
| 2,463,257 | 3/1949 | Fox | 297/301 |
| 2,606,592 | 8/1952 | McIntyre | 248/624 |
| 2,991,125 | 7/1961 | Lie | 297/304 |

FOREIGN PATENT DOCUMENTS

| | | | |
|---|---|---|---|
| 581679 | 1/1932 | Fed. Rep. of Germany | 297/304 |

*Primary Examiner*—James T. McCall

*Attorney, Agent, or Firm*—Stanley G. Ade; Adrian D. Battison

[57] ABSTRACT

A suspension arrangement for a chair of the type wherein a back and seat of the chair pivot conjointly but two different angles comprises a pair of main helical torsion springs spaced axially and supporting the back support relative to a main frame so that the back support can pivot about the axes of the springs. The seat is attached to the main frame by a forward pair of helical springs and to the back support by a rearward pair of helical springs so that the seat pivots about the front pair under control of the rear pair with the ratio of the angles controlled by the distance between the axes.

19 Claims, 5 Drawing Figures

SUSPENSION ARRANGEMENT FOR A TILTING CHAIR

BACKGROUND OF THE INVENTION

This invention relates to a suspension arrangement for a tilting chair of the type where a back and seat of the chair tilt rearwardly under pressure from an occupant with the back tilting through an angle greater than that of the seat.

The tilt mechanisms on chairs and particularly office chairs are commonly of three types. Firstly, there is a type in which the back of the chair tilts rearwardly under pressure from the occupant while the seat remains fixed. Secondly, there is a type in which the back and seat tilt together as a fixed unit. Thirdly, there is a type with which the present invention is concerned in which the back tilts at a larger angle than the seat.

The third type of tilting function is generally found on high quality and more expensive chairs and has advantages which are not provided by the more simple types mentioned previously.

A conventional device or suspension arrangement for providing a movement of this type is provided by a first pivot pin device which mounts a back support member of the chair on a base frame member so that the back can move rearwardly about a horizontal axis relative to the base frame. The base frame is generally attached to or includes legs by which the chair is mounted on the ground so the base frame remains stationary while the back tilts rearwardly under pressure from the occupant of the chair.

The seat is then mounted for pivotal movement about a second horizontal axis parallel to the first and forwardly of the first on the base frame so that it too can tilt rearwardly and downwardly under pressure from the occupant. In order to link the back and the seat for conjoint movement while controlling the angles of movement so that the back tilts more than the seat, the seat is attached to the back support by a third pivot pin arrangement.

The seat then tilts with the back but through an angle dependent upon the relative distances between the first and third pivot pins and between the second and third pivot pins. Generally, the ratio of the distances is chosen to be approximately 2:1 so that the back can tilt through, for example, 20° while the seat pivots through 10°.

An alternative arrangement for providing this tilting movement is shown in U.S. Pat. No. 3,072,436 (Moore). In this arrangement the seat and back are mounted for pivotal movement about pivot pins with the control of the movement of the seat being provided by sliding of a pin within a slot.

In both of these arrangements, the pivotal movement takes place about pivot pins with spring force being provided by a separate spring which resists the movement of the back and seat. The spring can in fact be positioned at any location in the mechanism and merely acts to apply a biassing force to maintain the seat and back in the upright or rest position.

SUMMARY OF THE INVENTION

It is one object of the present invention, therefore, to provide an improved suspension arrangement for a tilting chair of this type.

In accordance with a first aspect of the invention, therefore, there is provided a suspension arrangement for a tilting chair of the type wherein a back and seat of the chair tilt rearwardly under pressure from an occupant, the suspension arrangement comprising a back support member, a seat support member, a base frame member, first spring means interconnecting said back support member and said base frame member, second spring means interconnecting said seat support member and said base frame member and third spring means interconnecting said seat support member and said back support member, said first, second and third spring means providing the sole interconnection between said members and being arranged such that the back support member tilts through an angle greater than and proportional to an angle through which the seat support member is tilted.

In accordance with a second aspect of the invention there is provided a suspension arrangement for a tilting chair of the type wherein a back and seat of the chair tilt rearwardly under pressure from an occupant, the suspension arrangement comprising a back support member, a seat support member, a base frame member, means mounting the back support member on the base frame member for rearward tilting movement relative thereto about a horizontal axis, means mounting the seat support member on the base frame member for rearward tilting movement relative thereto about a horizontal axis, means interconnecting the seat support member and the back support member whereby to cause the seat support member to tilt with the back support member through an angle which is proportional to and less than an angle through which the back support member is tilted, at least one of said mounting means being constituted by a spring, flexing movement of which defines said horizontal axis.

According to a third aspect of the invention there is provided a suspension arrangement for a tilting chair of the type wherein a back and seat of the chair tilt rearwardly under pressure from an occupant, the suspension arrangement comprising a back support member, a seat support member, a base frame member, first mounting means mounting the back support member on the base frame member for rearward tilting movement relative thereto about a first horizontal axis, second mounting means mounting the seat support member on the base frame member for rearward tilting movement relative thereto about a second horizontal axis forward of and parallel to the first, third mounting means mounting the seat support member on the back support member for pivotal movement relative thereto about a horizontal axis rearward of and parallel to the first whereby the back support member and seat support member tilt rearwardly conjointly through angles proportioned in dependence upon the ratio of the distances between said first and third axes and between said second and third axes, at least one of said mounting means being constituted by a spring means which flexes about a substantially stationary axis defining said respective horizontal axis.

The invention therefore can provide one advantage whereby the use of pivot pins or pivot supports is totally omitted and the support of the back and seat relative to the base frame is provided solely by the springs which interconnect the back and seat support members relative to the base frame.

Such springs are preferably of the type which define by their flexing movement, an axis about which they flex, which axis remains stationary or substantially stationary. Such a spring can be provided by a helical torsion spring or a pair of such springs arranged in axially spaced relationship in order to provide lateral stability.

The main spring force can be provided by a spring interconnecting the base frame and the back support member with the seat being supported on a further subsidiary pair of spring arrangements each constituted by a pair of single helix torsion springs. With the main spring positioned centrally of the seat and the subsidiary springs at the front and rear of the seat, movement of a ratio 2:1 can be obtained while providing lateral stability and the desired feel of the chair to the occupant.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 2:
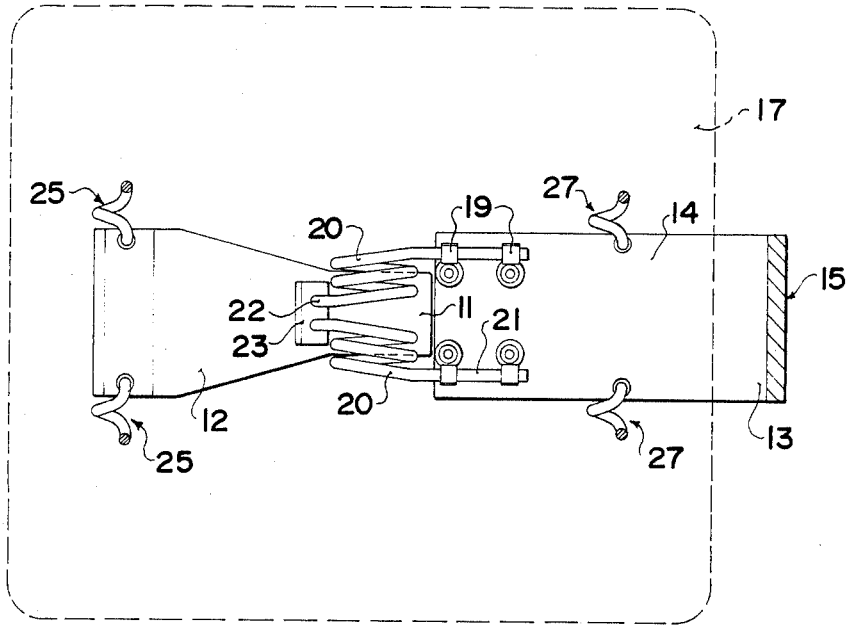
FIG. 2 is a view along the lines 2—2 of FIG. 1.
Figure 1:
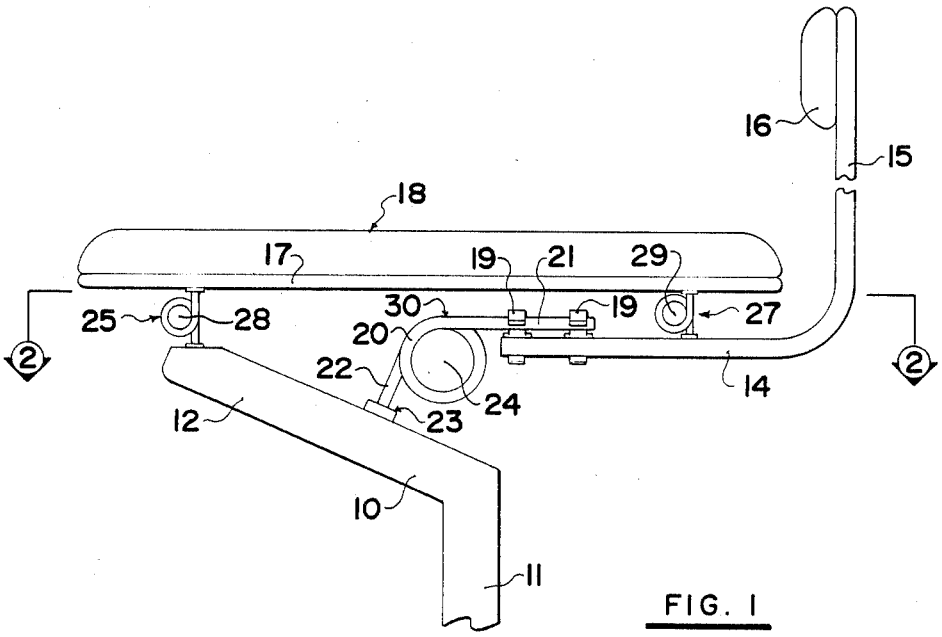
FIG. 1 is a side elevational view of a suspension arrangement for a chair according to the invention.
Figure 3:
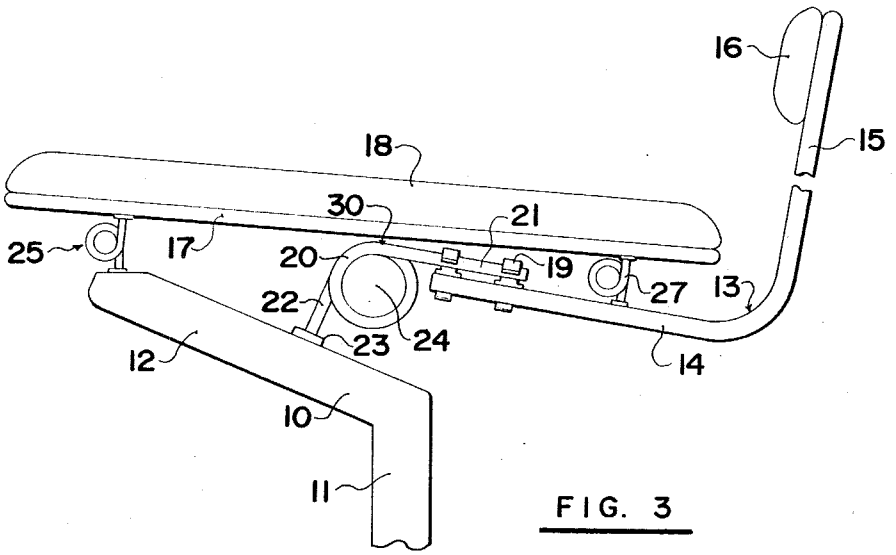
FIG. 3 is a side elevational view of the arrangement of FIG. 1 showing the arrangement in a tilted position.

The chair according to the invention as shown in FIGS. 1, 2 and 3 comprises a fixed base frame member 10 which can be mounted on legs (not shown) so as to be fixed relative to the ground, that is it does not tilt relative to the ground, although it may include castors to allow it to roll along the ground. The member 10 includes an upstanding leg 11 and a forwardly projecting plate 12 on which the chair back and chair seat are mounted.

A back support member 13 comprises a horizontal plate member 14 and an upstanding back plate member 15 which can receive suitable cushioning indicated schematically at 16. A seat support member in the form of a flat rectangular plate is indicated at 17 and again includes padding or cushioning schematically indicated at 18.

The back support member 13 and more particularly the plate member 14 carries on its upper surface two pairs of clamp members 19 of conventional construction each pair acting to clamp a leg of a torsion spring 20 so that the leg indicated at 21 is rigidly attached to the upper side of the plate member 14. Each spring 20 is formed as a helical torsion spring with two full turns of the helix, the turns being spaced from each other and terminating in a further outwardly extending leg 22 at an angle of the order of 230° to the leg 21.

The legs 22 of the springs 20 are then welded to a plate 23 attached to the upper surface of the plate member 12 of the base frame 10.

The back support 13 is by the springs 20 coupled to the base frame 10 for pivotal movement about an axis 24 which is the central axis of the helixes of the springs 20. It will be appreciated in this regard that the springs 20 are co-axial and spaced axially and thus provide lateral stability while allowing the plate 14 of the back support to rotate about the axis 24 in a clockwise direction as shown in FIG. 1 to the position illustrated in FIG. 3. The springs 20 are designed such that they can accommodate a rotational movement of the order of 20° while providing a resistive force which is suitable to resist the weight applied by the occupant of the chair. In the absence of an occupant, the resistive force of the springs 20 is sufficient to maintain the back support member 13 in a position illustrated in FIG. 1 with the plate member 14 horizontal.

In one example, the spring is formed from 0.312 inch diameter wire.

The plate 17 forming the seat support member is connected to the upper end of the plate 12 of the base frame 10 by a further pair of helical springs 25. In this case, the springs are welded to a pair of plates 26 which are screwed or welded to the plates 12 and 17 and the springs 25 form a single helix with the crossing parts of the turn spaced from each other to allow the spring to flex without rubbing of the spring.

The springs 25 are positioned at or adjacent the front of the plate 17 while further springs 27 similar to the springs 25 are positioned at or adjacent the rear edge of the plate 17 for attachment to the plate 14 of the back support 13.

The springs 25 and 27 again are arranged in co-axial pairs about the axes 28 and 29 so as to provide pivotal movement between the seat support 17 and the base frame 10 and between the seat support 17 and the back support 13 respectively. At the same time the spacing of the pairs of springs provides lateral stability so that the seat member 17 is effectively confined into rotation about the axes 28 and 29.

It will be appreciated that the spacing between the axis 28 and the axis 24 is approximately half the spacing between the axis 28 and the axis 29. In addition, the axis 24 lies beneath the axes 28 and 29 so that the upper edge of the springs 20 indicated at 30 is spaced from the undersurface of the plate member 17 by a distance which allows the plate 17 to tilt into the position shown in FIG. 3.

The seat member 17, the base frame 10 and the back support 13 are therefore basically interconnected solely by the springs 20, 25 and 27. As explained previously, the back support 13 is confined to movement in a rotational direction about the axis 24 which causes the spring 27 to move downwardly rotating about the axis 28. The seat support 17 therefore also rotates or tilts downwardly through an angle which is controlled in relation to the ratio of the distances between the axes.

As shown, where the ratio is of the order of 2:1, the seat support 17 can move through an angle of the order of 10° while the back support 13 moves through an angle of the order of 20°.

The slight lateral movement required between the back support 13 and the seat support 17 in this generally rotational movement is taken up in the springs 24, 25 and 27.

It will be appreciated therefore that the number of parts provided in the arrangement shown in FIGS. 1, 2 and 3 is considerably reduced relative to previous arrangements where pivot couplings have been provided by pivot pins. In addition, there are effectively no relatively movable parts in the arrangements since all movement is taken up by the flexing of springs. This, of course, eliminates wear and noise between the parts.

Figure 5:
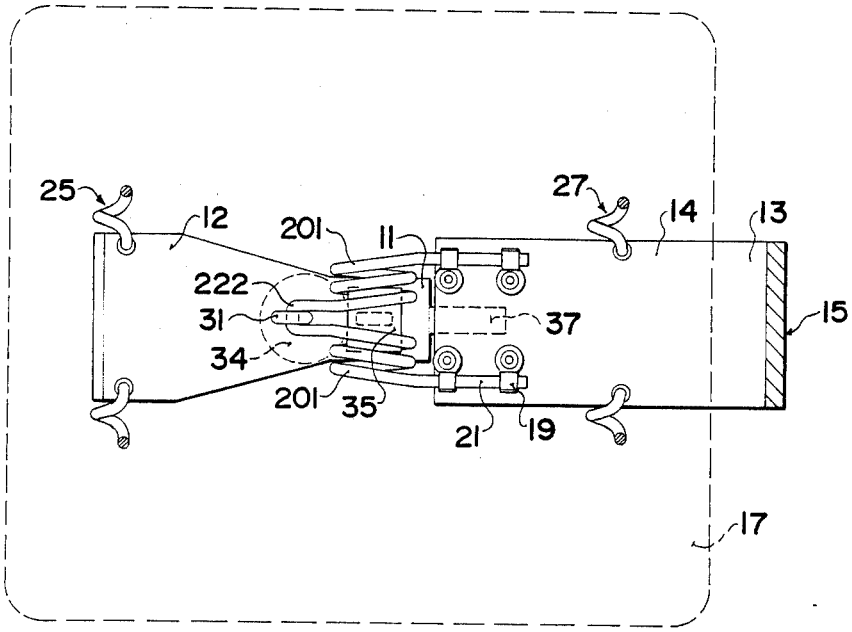
FIG. 5 is a plan view along the lines 5—5 in FIG. 4.
Figure 4:
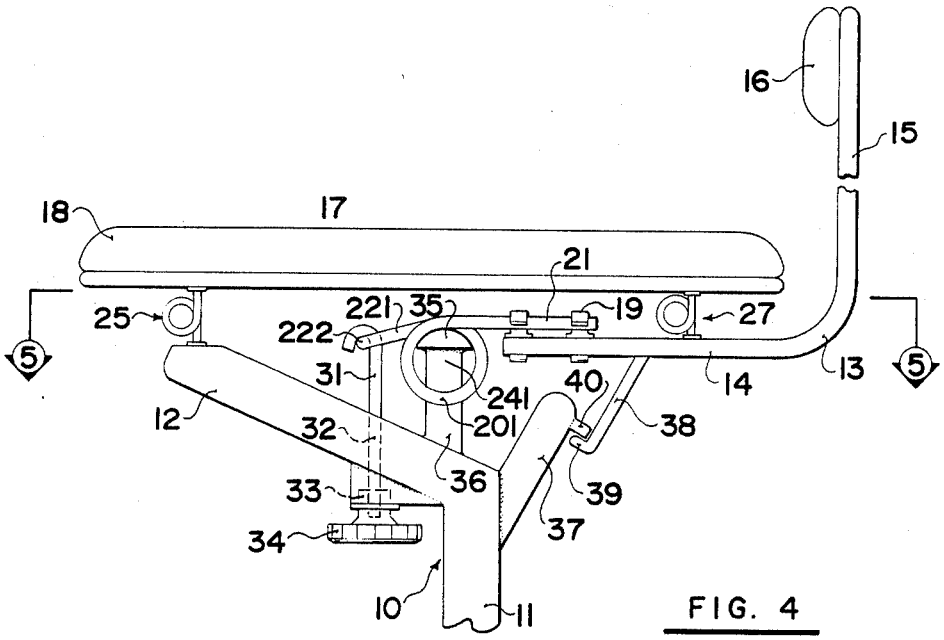
FIG. 4 is a side elevational view similar to FIG. 1 of a modified arrangement.

In a modified arrangement illustrated in FIGS. 4 and 5, the construction is substantially as previously described except that the spring 20 is now modified with the modified arrangement illustrated at 201. In this case, the leg of the spring 201 indicated at 221 instead of being attached directly to the base frame 10, extends from the spring 201 at about 180° from the leg 21. The legs 221 of the springs 201 can in fact be joined at a central section 222 so that the springs 201 are effectively combined into a single item for manufacture.

In this case, an I-bolt 31 passes through the loop formed by the legs 221 and the connecting section 222 and then passes through an opening 32 in the plate 12 of the base frame 10 for connection to a conventional adjustment nut arrangement generally indicated at 33. Via operation of a wheel 34, the axial extent of the I-bolt 31 above the base frame 10 can be adjusted so as to control or vary the angle of the legs 221 of the spring 201 relative to the legs 21.

A support member 35 provides a horizontal support bar which projects a short distance into the helixes of the springs 201 for contacting the upper portion of the innermost turn of the helix. The support bar 35 is mounted on the base frame 10 by a leg 36 so as to be rigidly attached thereto.

The back support 13 is therefore attached to the base frame 10 by the spring 201 and again can flex or tilt relative to the base frame 10 in a clockwise direction about the axis 241 of the spring 201. The spring resistance provided by the spring 201 is adjusted as previously explained by adjustment of the I-bolt 31 which tightens or loosens the helixes of the springs 201. In this case, the spring 201 is supported relative to the base frame 10 by the member 35 but the member 35 does not provide a pivot coupling between the back support 13 and the base frame 10 since the pivotal movement takes place about the axis 241 of the spring 201.

In order to prevent the seat support 17 from engaging the springs 201 and pressing them against the support 35, a stop member 37 is positioned on the base frame 10 immediately behind the support member 35 in order to engage the back support member 13 to prevent movement beyond the desired position. It will be appreciated that the stop 37 can be positioned at any location in the arrangement engaging either the back support member 13 or the seat support member 17.

In addition, in order to limit upward movement at the back and seat under spring force from the spring 201, an upper limit stop 38 is provided which is attached to the seat support member 14 and includes a notch 39 for engaging a notch 40 on the stop 37.

The spring coupling arrangements illustrated in the drawings which are of the helical torsion spring type could be replaced by torsion bars or by spiral springs which again are arranged to provide pivotal movement about a substantially fixed axis. In some cases one or more of the springs 24, 25, 27 could be replaced by pivot couplings or by some other form of coupling which provides the necessary movement.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A suspension arrangement for a tilting chair of the type wherein a back and seat of the chair tilt rearwardly under pressure from an occupant, the suspension arrangement comprising a back support member, a seat support member, a base frame member, first spring means interconnecting said back support member and said base frame member, second spring means interconnecting said seat support member and said base frame member and third spring means interconnecting said seat support member and said back support member, said first, second and third spring means providing the sole structural interconnection between said members and being arranged such that each provides pivotal movement about an axis of movement without the use of hinges whereby the back support member tilts through an angle greater than and proportional to an angle through which the seat support member is tilted.

2. The invention according to claim 1 wherein each of said spring means comprises a helical spring defining an axis of movement at the centre of the helix.

3. The invention according to claim 1 wherein each spring means comprises a pair of axially spaced helical springs.

4. The invention according to claim 1 wherein the first spring comprises a main spring means providing the majority of spring force resisting tilting of said back and seat support members.

5. The invention according to claim 4 including means for adjusting the spring force of said main spring means.

6. The invention according to claim 1 wherein said first spring is spaced from the seat support member sufficient just to accommodate movement thereof.

7. A suspension arrangement for a tilting chair of the type wherein a back and seat of the chair tilt rearwardly under pressure from an occupant, the suspension arrangement comprising a back support member, a seat support member, a base frame member, means mounting the back support member on the base frame member for rearward tilting movement relative thereto about a horizontal axis, means mounting the seat support member on the base frame member for rearward tilting movement relative thereto about a horizontal axis, means interconnecting the seat support member and the back support member whereby to cause the seat support member to tilt with the back support member through an angle which is proportional to and less than an angle through which the back support member is tilted, each of said mounting means consisting solely of a spring, flexing movement of which defines said horizontal axis.

8. The invention according to claim 7 wherein said spring comprises a helical spring with the axis defined at the centre of the helix.

9. The invention according to claim 8 wherein the spring comprises a pair of axially spaced helical springs.

10. The invention according to claim 7 wherein the back support member mounting means comprises a main spring which provides the majority of spring force resisting tilting movement of the back and seat support members.

11. The invention according to claim 10 including means for adjusting the spring force of said main spring means.

12. A suspension arrangement for a tilting chair of the type wherein a back and seat of the chair tilt rearwardly under pressure from an occupant, the suspension arrangement comprising a back support member, a seat support member, a base frame member, first mounting means mounting the back support member on the base frame member for rearward tilting movement relative thereto about a first horizontal axis, second mounting means mounting the seat support member on the base frame member for rearward tilting movement relative thereto about a second horizontal axis forward to and parallel to the first, third mounting means mounting the seat support member on the back support member for pivotal movement relative thereto about a horizontal axis rearward of and parallel to the first whereby the back support member and seat support member tilt rearwardly conjointly through angles proportioned in dependence upon the ratio of the distances between said first and third axes and between said second and third axes, each of said mounting means comprising a helical spring means which flexes about a substantially stationary axis defined by said spring means centrally of said helical spring means and defining said respective horizontal axis.

13. The invention according to claim 12 wherein each of said mounting means is constituted by a spring means which flexes about a substantially stationary axis defining said respective horizontal axis.

14. The invention according to claim 13 wherein said back support member, said seat support member and said base frame member are interconnected solely by said spring means.

15. The invention according to claim 12 wherein the spring means comprises a pair of axially spaced helical springs.

16. The invention according to claim 12 wherein the first mounting means is constituted by a spring means which flexes about a substantially stationary axis defining said first horizontal axis and wherein said spring means comprises a main spring means providing the majority of spring force resisting tilting movement of the back and seat support members.

17. The invention according to claim 16 including means for adjusting the spring force of said main spring means.

18. The invention according to claim 12 wherein said first and second mounting means each comprises spring means and wherein the first spring means is mounted on said frame support member at a position lower than the second spring means so that the axis thereof is lower than the axis of said second spring means.

19. The invention according to claim 18 wherein the top of said first spring means is spaced below said seat support member by a distance just sufficient to accommodate tilting movement of said seat support member.

* * * * *